US006685367B1

(12) United States Patent
Reynolds et al.

(10) Patent No.: US 6,685,367 B1
(45) Date of Patent: Feb. 3, 2004

(54) IMAGE PROCESSING APPARATUS AND METHOD FOR THERMALLY PROCESSED FILMS

(75) Inventors: James H. Reynolds, Rochester, NY (US); David H. Levy, Rochester, NY (US); Mark E. Irving, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 318 days.

(21) Appl. No.: 09/592,243

(22) Filed: Jun. 13, 2000

(51) Int. Cl.[7] ..... G03D 13/00

(52) U.S. Cl. ..... 396/575; 355/27; 355/77; 241/100; 241/236; 219/216; 430/353; 430/434

(58) Field of Search ..... 396/567–570, 396/575, 564; 355/27–29, 40, 30; 430/434; 241/236, 100, 375, 60

(56) References Cited

U.S. PATENT DOCUMENTS

| | | | | |
|---|---|---|---|---|
| 3,864,709 A | | 2/1975 | Bruns | 396/575 |
| 3,957,517 A | | 5/1976 | Ikenoue et al. | |
| 4,009,034 A | | 2/1977 | May | 430/353 |
| 4,021,240 A | | 5/1977 | Cerquone et al. | 430/203 |
| 4,226,372 A | | 10/1980 | Wigand | |
| 4,355,766 A | | 10/1982 | Wigand | |
| 4,615,490 A | | 10/1986 | Goldhammer | |
| 4,701,125 A | | 10/1987 | Kitchens et al. | |
| 4,767,564 A | | 10/1988 | Kitchens et al. | |
| 4,788,559 A | * | 11/1988 | Ende | |
| 4,941,290 A | * | 7/1990 | Holyoke | |
| 5,003,334 A | | 3/1991 | Pagano et al. | 396/515 |
| 5,003,405 A | | 3/1991 | Wulforst | |
| 5,031,285 A | | 7/1991 | Wallo | 24/66.2 |
| 5,046,286 A | | 9/1991 | Holyoke | |
| 5,113,351 A | | 5/1992 | Bostic | 396/564 |
| 5,200,777 A | | 4/1993 | Zander | 396/513 |
| 5,226,613 A | | 7/1993 | Kataoka et al. | 242/348.2 |
| 5,354,001 A | * | 10/1994 | Hasegawa | 241/34 |
| 5,405,740 A | | 4/1995 | LaBelle | |
| 5,537,767 A | | 7/1996 | Schneider et al. | 40/606 |
| 5,627,016 A | | 5/1997 | Manico | 430/434 |
| 5,664,253 A | | 9/1997 | Meyers | 396/603 |
| 5,666,191 A | * | 9/1997 | Hasegawa et al. | 399/366 |
| 5,692,221 A | | 11/1997 | Tobioka et al. | 396/6 |
| 5,698,365 A | | 12/1997 | Taguchi et al. | 430/203 |
| 5,756,269 A | | 5/1998 | Ishikawa et al. | |
| 5,858,629 A | | 1/1999 | Ishikawa et al. | |
| 6,048,110 A | | 4/2000 | Szajewski et al. | 396/575 |
| 6,051,813 A | | 4/2000 | Struble | 219/216 |
| 6,062,746 A | | 5/2000 | Stoebe et al. | |
| 6,154,295 A | | 11/2000 | Fredlund et al. | |
| 6,203,603 B1 | * | 3/2001 | Takayama et al. | 106/31.16 |
| 6,274,299 B1 | | 8/2001 | Buhr et al. | |
| 6,464,412 B1 | | 10/2002 | Stoebe et al. | |
| 6,500,590 B2 | | 12/2002 | Irving et al. | |

FOREIGN PATENT DOCUMENTS

| | | | |
|---|---|---|---|
| EP | 0 234 833 A2 | | 2/1987 |
| EP | 0 766 842 B1 | | 8/1995 |
| EP | 0 800 114 A | | 10/1997 |
| FR | 2764628 | * | 12/1998 |
| JP | 04-260038 | * | 9/1992 |

OTHER PUBLICATIONS

Research Disclosure vol. 170, 6/78, Item #17029 and vol. 299, 3/89, Item #29963.

* cited by examiner

*Primary Examiner*—D Rutledge
(74) *Attorney, Agent, or Firm*—David A. Novais

(57) ABSTRACT

In the processing of thermal films, following processing, negatives are scanned and the resulting image files are digitally manipulated to render a desired output. Since it is desirable to return thermally processed films to a control location for silver recovery, the negatives are not returned to the consumer. In the method and apparatus of the present invention, after processing and scanning, the film or negative can be rendered unscannable by heating it to a temperature that develops the entire film to its maximum density and destroys the images on the film. As a further option, the film can be physically destroyed by use of for example, a shredder or illuminator downstream of the scanner.

19 Claims, 5 Drawing Sheets

IMAGE PROCESSING APPARATUS AND METHOD FOR THERMALLY PROCESSED FILMS

FIELD OF THE INVENTION

The present invention relates to a method and apparatus for processing thermally developable film which involves destroying negatives after the processing and scanning of the film.

BACKGROUND OF THE INVENTION

In the conventional practice of color photography, silver halide film is developed by a chemical technique requiring several steps consisting of latent image developing, bleaching, fixing and washing with the active reagents supplied in dilute solutions. While this technique has been perfected over many years and results in exceptional images, the technique requires the delivery and disposal of several chemicals and precise control of times and temperatures of development. Further, because of the mechanical constraints inherent in a wet solution process, the conventional silver halide chemical development technique is not particularly suitable for utilization with compact developing apparatuses. Nevertheless, attempts to provide convenient processing have been described by Sabbagh in EPO Published Application 0 234 833, by Bostic in U.S. Pat. No. 5,113,351, by Manico in U.S. Pat. No. 5,627,016 and by Meyers in U.S. Pat. No. 5,664,253. These approaches have not proven to be viable because of the problems mentioned above. Further, the chemical technique which is a wet processing technique is also not easily performed in the home or small office.

Imaging systems that do not rely on conventional wet processing have received increased attention in recent years. Photothermographic imaging systems have been employed for producing silver images. Typically, these imaging systems have exhibited very low levels of radiation-sensitivity and have been utilized primarily where only low imaging speeds are required. A method and apparatus for developing a heat developing film is disclosed in U.S. Pat. No. 5,537,767. Summaries of photothermographic imaging systems are published in Research Disclosure, Volume 170, June 1978, Item 17029, and Volume 299, March 1989, Item 29963. Other heat development color photographic materials have been disclosed, for example, in U.S. Pat. No. 4,021,240 and U.S. Pat. No. 5,698,365.

U.S. Pat. No. 6,048,110 also discloses an apparatus for thermal development which comprises the use of a thrust cartridge. Also, commercial products such as Color Dry Silver supplied from Minnesota Mining and Manufacturing Company and Pictography™ and Pictrostat™ supplied by Fuji Film Co., Ltd. have been on the market.

Because they do not undergo a wet bleaching or fixing stage, thermally processed films retain all of the silver (in the form of both silver ion and elemental silver) that is used to capture and form the image. It is desirable for manufacturers of photothermographic films to recover and recycle this silver, and it is convenient to use the film itself as the recycling unit and return all processed films to a central location for silver recovery. Instead of returning the negative to the customer, it is preferable to provide the customer with a permanent image from thermally processed film in the form of a print, and/or a digital file archived on a machine-readable optical disk (CD, picture disk or photo CD), and/or replacement negatives written onto archival media from the digital file. However, the prospect of not returning negatives to a customer raises concerns about customer privacy after the processing and scanning of the thermal film.

SUMMARY OF THE INVENTION

The present invention provides for an image processing apparatus and method for thermally processed films which addresses the above mentioned consumer privacy concerns by destroying the film or negative after processing and scanning. Photothermographic film utilized in the present invention can be processed at a kiosk or a networked photofinishing appliance. In processing photothermal film, after processing, negatives are scanned and the resulting image files are digitally manipulated to render a desired output. The output may include photographic prints, an index print, a floppy disk, a machine-readable optical disk, replacement negatives written onto archival media from the digital file, or digital image files uploaded to a network. A specific apparatus suitable for a photofinishing system applicable to the present invention is discussed in, for example, U.S. Pat. No. 6,048,110.

The present invention therefore relates to an image processing apparatus which comprises a first heater for heating an exposed thermal film to a first temperature suitable for thermal processing of the exposed thermal film; a scanner for scanning the thermally processed film to create a digital record file representative of images on the thermally processed film; and a second heater for heating the thermally processed film to a second temperature which develops the film to a maximum density level. The second temperature may be comparable or higher than the first temperature. In the event that scanning of the film subjects the imaging element to light to which it is sensitive, thus producing an abundance of latent image exposure, there is no need for the second heating step to occur at a temperature above that of the first.

The present invention further relates to an image processing apparatus which comprises the capability to process film though a high temperature processor, scan the film and rewind the film through the heated processor at the same temperature as for the initial processing of the film. In the event that scanning of the film subjects the imaging element to light to which it is sensitive, thus producing an abundance of latent image exposure, the second pass through the thermal processor will have the effect of rendering a Dmax density uniformly on the film.

The present invention further relates to an image processing apparatus which comprises an adjustable heating assembly having at least a first temperature setting suitable for thermal processing of an exposed thermal film and a second temperature setting equal to or higher than the first temperature setting suitable for destroying images on the thermally processed film; and a scanner for scanning the thermally processed film to create a digital record file of images on the thermally processed film. After scanning, the thermally processed film is conveyed back to the heating assembly where the heating assembly is set at the second temperature setting for destroying the images on the thermally processed film.

The present invention further relates to an image processing apparatus which comprises a heater for heating an exposed thermal film to a temperature suitable for thermal processing of the exposed film; a scanner for scanning the thermally processed film to create a digital record file representative of images on the thermally processed film; and a destroying member for destroying the thermally processed film after the film has been scanned. The destroying member could be, for example, a film shredder that physically fractionates the image, a high intensity illuminator that fogs the image by printout, or a treatment that chemically obscures the image or physically bonds the film such that it cannot be unrolled when wound upon itself. Chemicals to obscure the image, for example, could be unreactive dyes or pigments, reactive dyes or pigments, reducing agents, oxidizing agents, and the like. Chemicals to bond the film, for example, could be water, solutions of gelatin, hydroxyethyl cellulose, or other binders, adhesives, glues and the like. Methods of chemical application could be any known in the art including spraying, dunking, coating, gravure, inkjet, lamination, and the like.

The present invention further provides for an image processing method which comprises the steps of heating an exposed thermal film to a first temperature suitable for thermal processing of the exposed film; scanning the thermally processed film to create a digital record file representative of images on the thermally processed film; and after the scanning step, heating the thermally processed film to a second temperature equal to or higher than the first temperature which destroys the images on the thermally processed film.

The present invention further relates to an image processing apparatus which comprises a heater adapted to maintain a temperature suitable for thermal processing of an exposed thermal film, and a scanner for scanning the thermally processed film to create a digital record file of images on the thermally processed film. The scanner produces a light exposure output at levels and spectral regions sufficient to fully expose a photographic element on the film wherein after scanning, the thermally processed film is conveyed back to the heater where, due to the light exposure by the scanner, the thermal process at the heater destroys the images on the thermally processed film.

The present invention further relates to an image processing method which comprises the steps of heating an exposed thermal film to a temperature suitable for thermal processing of the exposed film; scanning the thermally processed film to create a digital record file representative of images on the thermally processed film; and after the scanning step, destroying the thermally processed film.

DETAILED DESCRIPTION OF THE INVENTION

Figure 1:
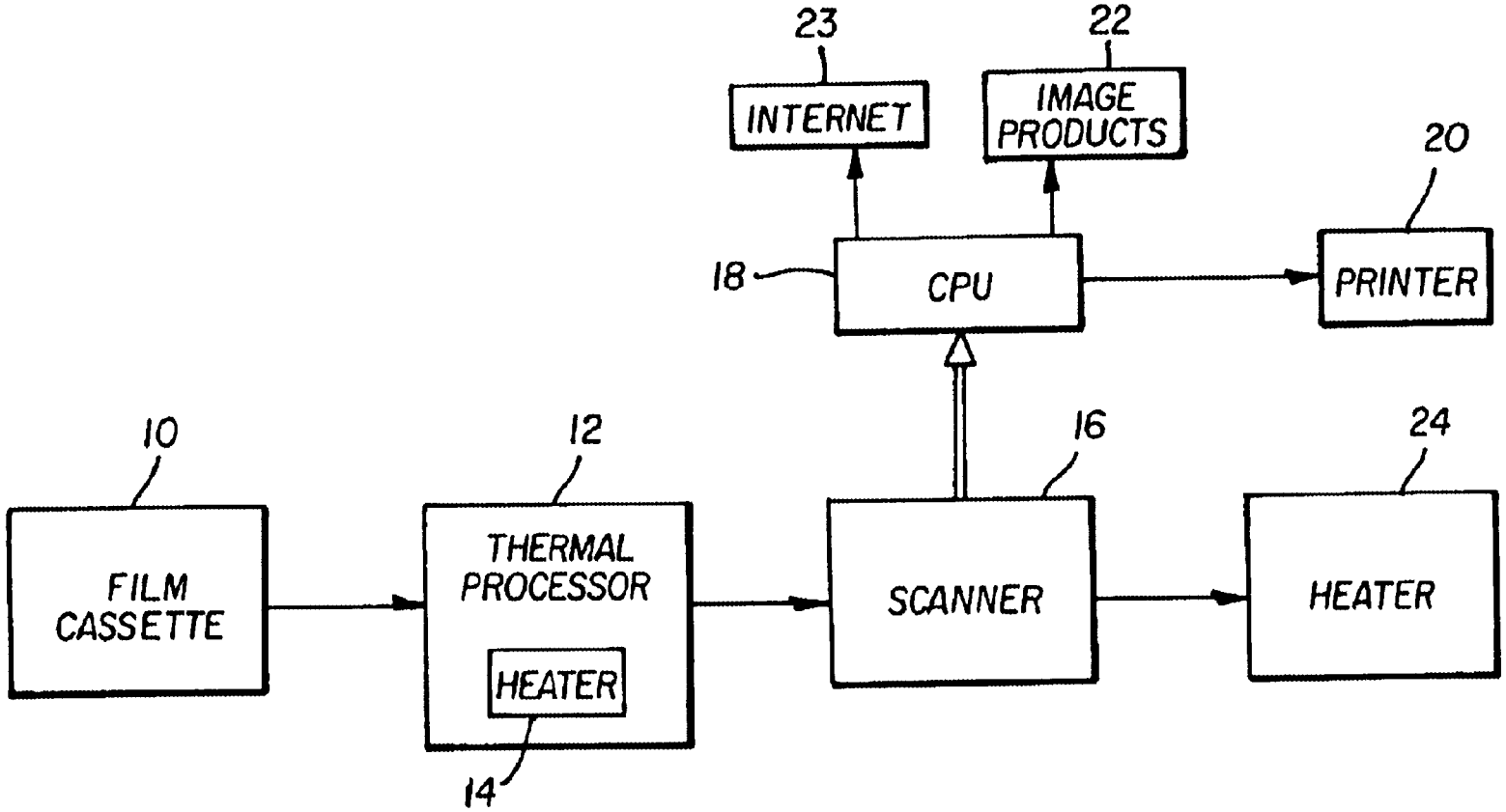
FIG. 1 is a schematic illustration of a first embodiment of the apparatus and method of the present invention.

Referring now to the drawings, wherein like reference numerals represent identical or corresponding parts throughout the several views, FIG. 1 illustrates a first embodiment of the apparatus and method of the present invention. More specifically, FIG. 1 schematically illustrates a thermal processing system for processing thermal film according to the first embodiment of the present invention. The processing system shown in FIG. 1 can be a kiosk or a networked photofinishing location. As illustrated in FIG. 1, a film cassette which can be a roll of exposed thermal film 10 in a thrust cartridge as described in, for example, U.S. Pat. No. 6,048,110, is conveyed to a thermal processor 12. Thermal processor 12 includes a heater 14, which can be any suitable type of heater. For example, the heater can be a radiant heater, heated liquid, heated air, dielectric heater, microwave radiation, conduction or convection. In a preferred feature of the present invention, the heater is a resistive heater in the form of a late or a drum, as this provides maximum transfer efficiency for heat to film 10.

The thermal film utilized in the present invention may be any film hat provides satisfactory images. Typical films are full colored thermal films such as disclosed in U.S. Pat. No. 5,698,365. A typical film provides light sensitive silver halides, compounds that form dyes, compounds that release dyes, couplers as dye donating compounds, reducing agents, and binders on supports.

Light sensitive elements or films used for the present invention can be supplied in thrust cartridges or cassettes as disclosed in, for example U.S. Pat. Nos. 5,226,613, 5,200,777, 5,031,285, and 5,003,334. The thrust cartridges may be employed in reloadable cameras designed specifically to accept such film cassettes, in cameras fitted with an adapter designed to accept such film cassettes or in single use cameras designed to accept such cassettes.

Narrow-bodied single use cameras suitable for employing thrust cartridges are described in U.S. Pat. No. 5,692,221. While the film may be mounted in a single use camera in any manner known in the art, it is preferred to mount the film in a single use camera such that it is taken on exposure by a thrust cartridge.

After processing in thermal processor 12 via heater 14 to develop the images on the film, the processed exposed film or negative is scanned at scanner 16 to create a digital record file of the images on film 10. The digital record file can be sent to or uploaded to a CPU 18 or other processing unit or network for digital image manipulation. The output from CPU 18 can thereafter be sent to a printer 20 for creating photographic prints, an index print, or a replacement negative; an image product station 22 to produce image products such as floppy discs, a machine-readable optical disk, etc., or uploaded to a network service provider 23 such as the internet.

As described above, after thermal processing of thermal film 10, it is preferable not to return the negative to a consumer. Therefore, in the first embodiment of the invention as illustrated in FIG. 1, after scanning by scanner 16, the processed exposed thermal film is sent to a second heater 24 downstream of scanner 16. Thus, in the embodiment illustrated in FIG. 1 thermally processed negatives are not returned to the consumer, but are destroyed after the scanning operation by use of second heater 24. More specifically, in the embodiment of FIG. 1, after scanning to create a digital record file of the image, the thermal film is rendered unscannable by heating it to a temperature that develops the entire film to its maximum density and thus destroys the images on the film. For example, the film can be developed at thermal processor 12 via heater 14 which operates within a development temperature range of approximately 100° to 180° C., after scanning the thermal film can be rendered unscannable by heating it a second time to a temperature of approximately 100°–300° C. (or 0° C. to 120° C. greater than the development temperature) to destroy images on the film (assuming that the time in which the heating stage that renders the film unscannable is approximately equal to the development time). Since the scanning operation exposes the entire film surface to light and forms a latent image throughout the film, it can also be sufficient simply to reheat the film under its original processing conditions to destroy the scene image. In the event that the film scanner employs radiation that does not produce a latent image on the film, the temperature to render the film unscannable can be 10°–50° C. higher than the original process temperature.

Figure 2:
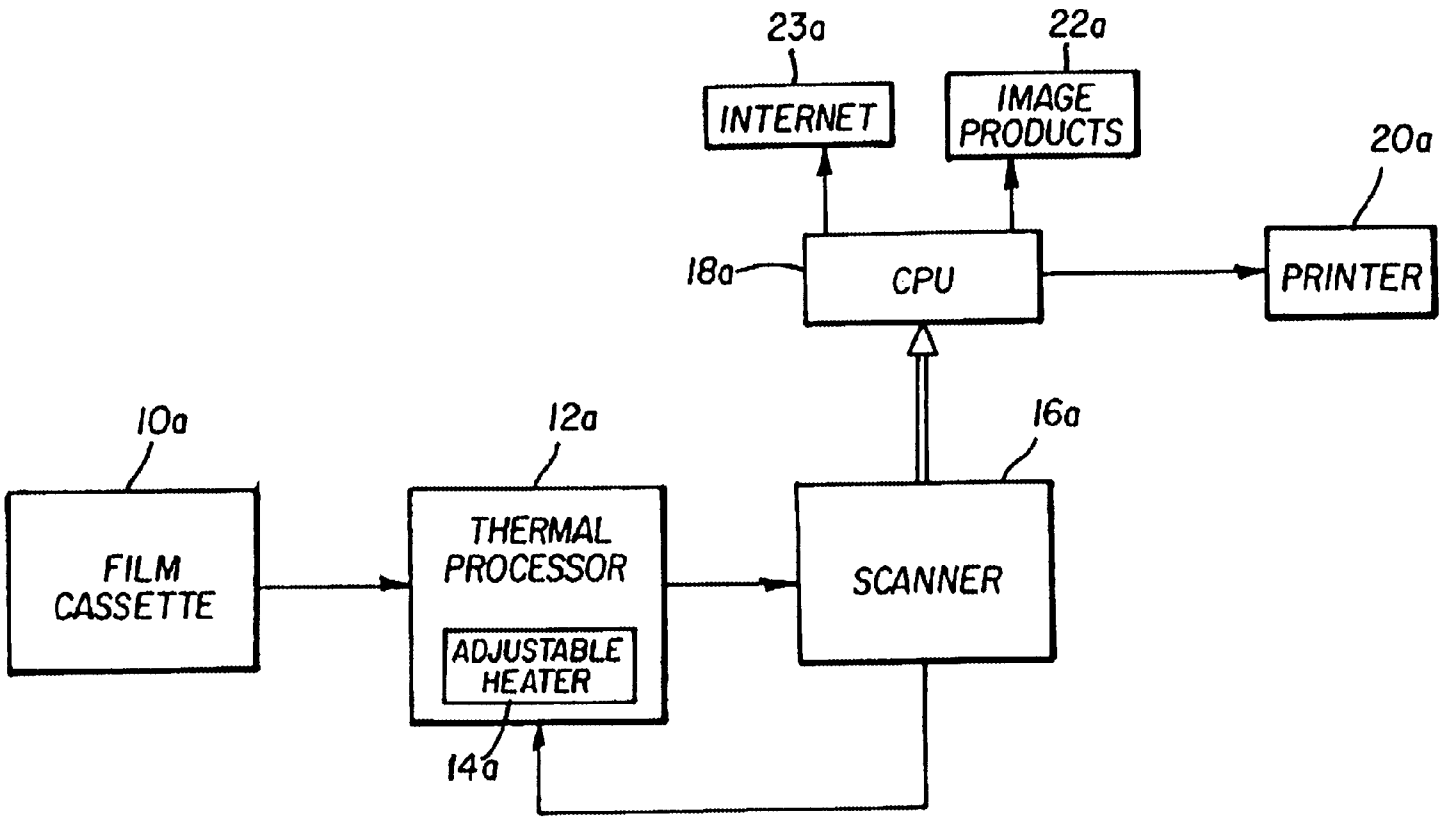
FIG. 2 is a schematic illustration of a second embodiment of the apparatus and method of the present invention.

FIG. 2 illustrates a second embodiment of the method and system of the present invention. As illustrated in FIG. 2, thermal film 10*a* from a film cassette is conveyed to a thermal processer 12*a*. As described above, the thermal processer 12*a* processes the thermal film by way of a heating element.

In the embodiment of FIG. 2, the heating element is in the form of an adjustable heater 14*a* which can be adjusted to a variety of temperature settings. For example, adjustable heater 14*a* has at least a first temperature setting for thermally processing film 10*a* to develop images on the film. After processing, the film is sent through a scanner 16a where the processed film is scanned to create a digital record file of images on the film. The digital record file is sent to a CPU 18*a* for enabling the printing of images via for example, printer 20*a*, the rendering of image products 22*a* such as Photo CD's etc., or the download of images to a network service provider 23*a* such as the internet. In the embodiment of FIG. 2, all of the heating is done by a single element 14*a*. Therefore, after scanning, the film or negative is returned to adjustable heater 14*a*. Adjustable heater 14*a* includes at least a second temperature setting which is equal to or higher than the first temperature by 0 to 120° C. and is suitable to destroy the images on the film. Adjustable heater 14*a* can be a single element such as a drum or platen with an adjustable temperature setting or a resistive heating element having an electrical current control. Further, in the present invention the scanner can be adapted to produce light exposure output at levels and spectral regions sufficient to fully expose a photographic element on the film. In this scenario, after scanning, the thermally processed film is conveyed back to the heater, where due to the light exposure by the scanner, the thermal process at the heater destroys images on the thermally processed film.

Figure 3:
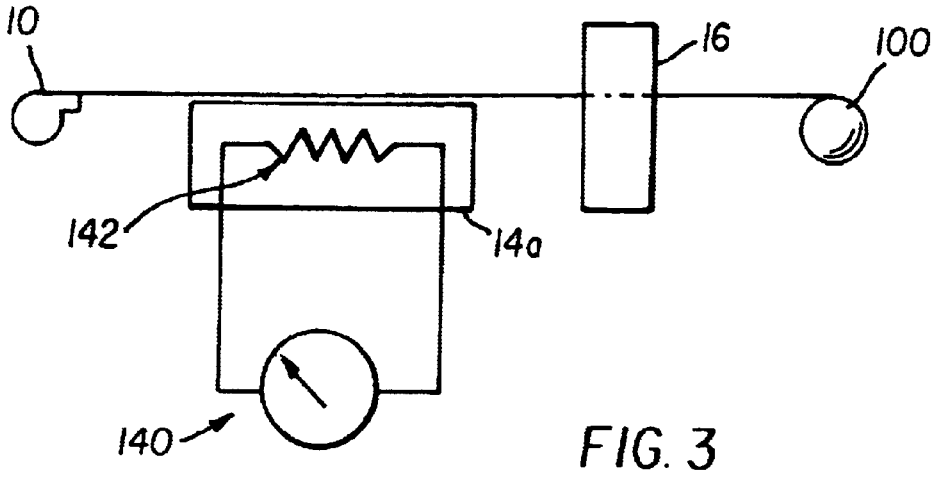
FIG. 3 is a schematic illustration showing an adjustable heater.

FIG. 3 is an example of adjustable heater 14*a* having an electrical current (temperature) control arrangement 140. In the arrangement of FIG. 3, after scanning the film can be drawn from winder 100 and inserted into adjustable heater 14*a* having a control arrangement 140 and a resistive heating element 142. Thus, the temperature can be optionally adjusted to the second temperature setting suitable for destroying the film.

Figure 4:
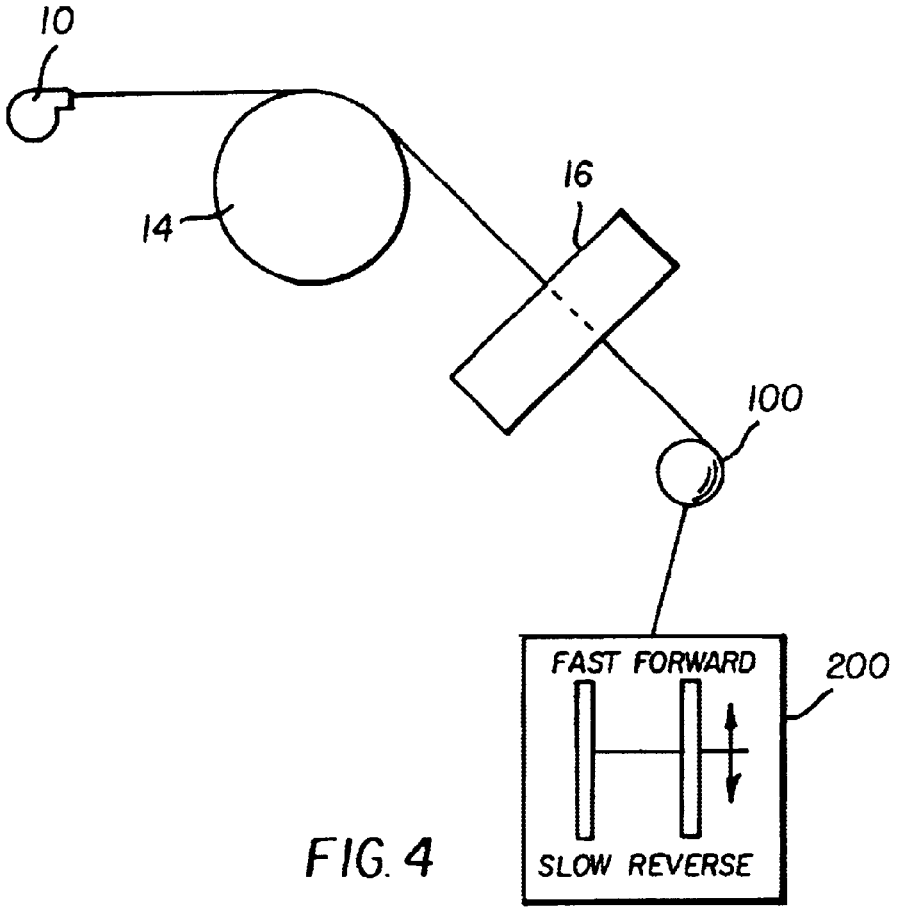
FIG. 4 is an embodiment showing a film speed control arrangement.

In a further feature of the invention, the heater can be a single temperature element which is utilized to destroy film by increasing the residence time of the film at the heater. Thus for destroying the film, the film would be heated for a period of time which is greater than or substantially equal to the period necessary for thermally processing the film. Of course, a combination of shorter heating times and higher temperatures could be employed to destroy the film. As an example, a short high temperature, such as 250° C. at ½ sec. to 5 sec. could also be suitable, For example, FIG. 4 illustrates a system which includes a speed control arrangement 200. With the arrangement of FIG. 4 it is possible to control the residence time of the film at heater 14. In the example of FIG. 4, heater 14 is a drum type heater. Thus, with the arrangement of FIG. 4, during normal processing, speed control arrangement 200 can be maintained at a normal processing speed for development at heater 14. When it is desired to destroy the images on the film, speed control arrangement 200 can be adjusted to slow down the film speed and thereby increase the residence time of the film at heater 14. It is noted that the speed of the film at heater 14 for the purpose of destroying the film can basically be a function of temperature, since a higher temperature at heater 14 would mean a shorter residence time of the film at heater 14, and an appropriate adjustment of speed control arrangement 200.

Figure 5:
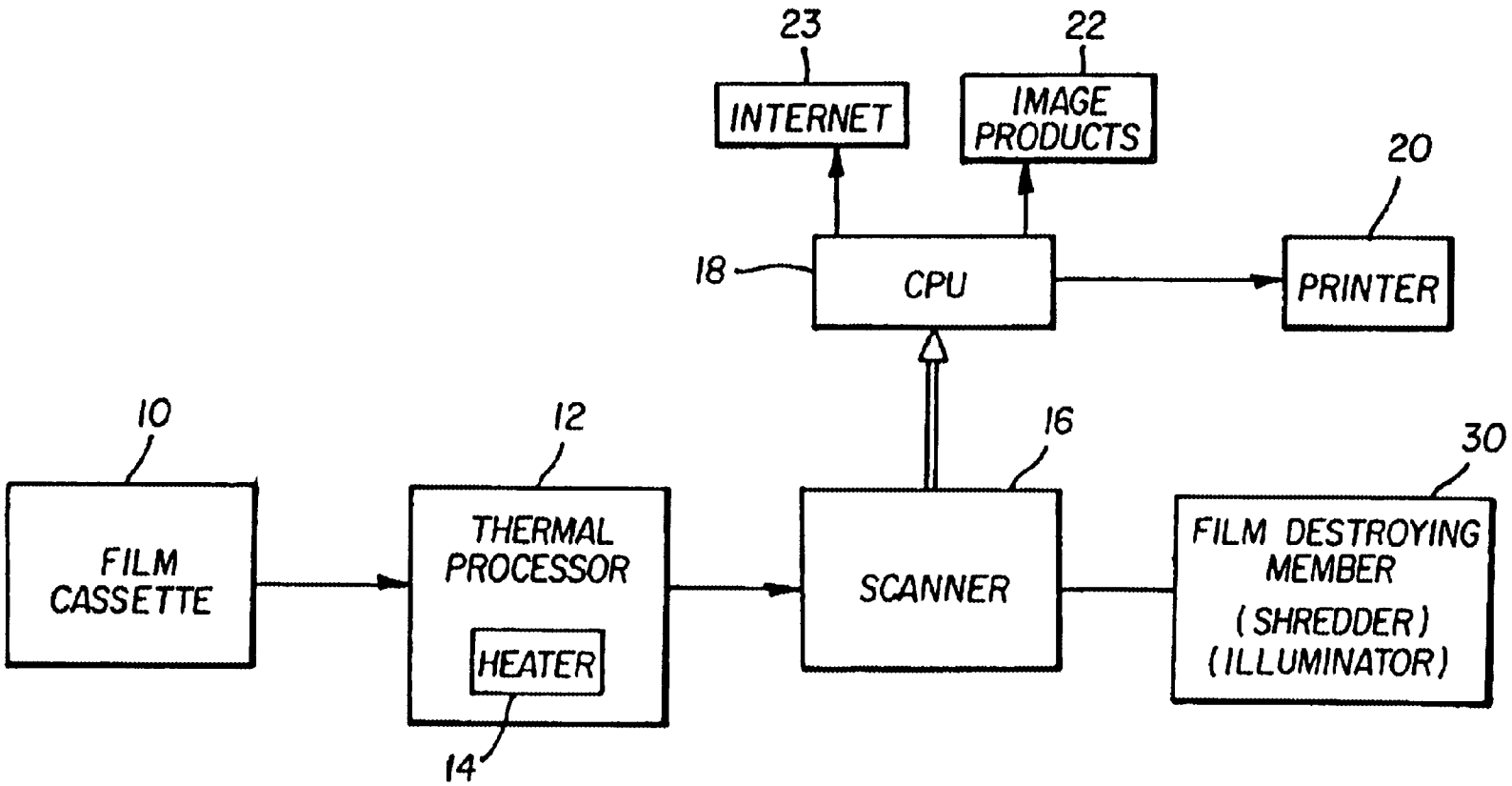
FIG. 5 is a schematic illustration of a third embodiment of the apparatus and method of the present invention.
Figure 6:
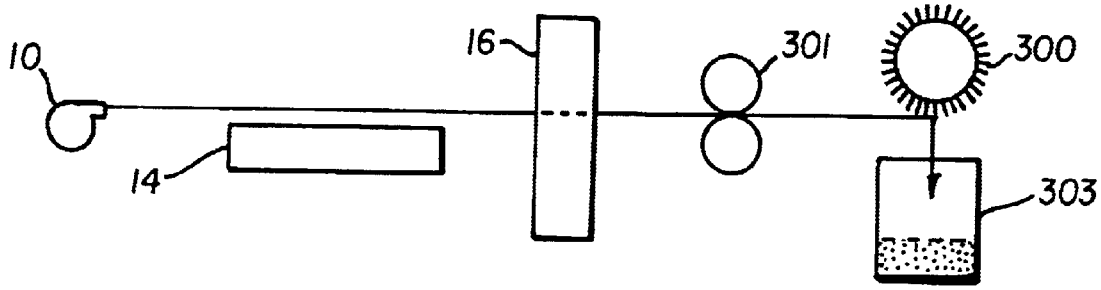
FIGS. 6–8 schematically illustrate different embodiments of film destroying members.
Figure 7:
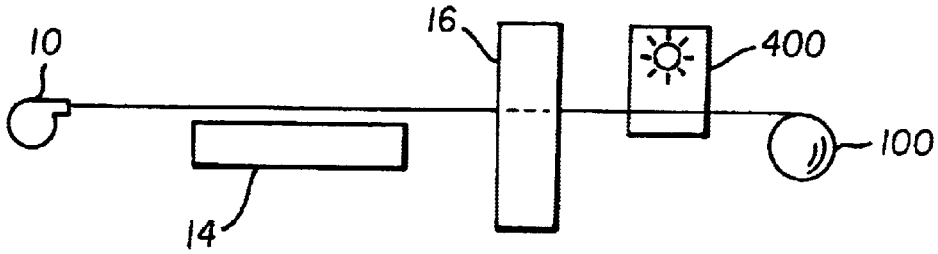
Figure 8:
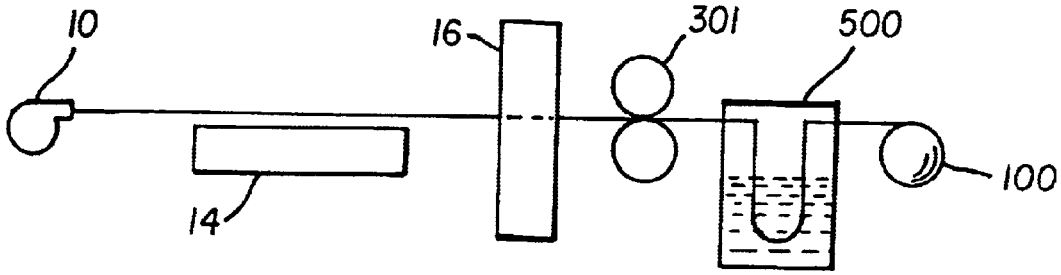

FIG. 5 illustrates a further embodiment of the apparatus and method of the present invention. In the embodiment of FIG. 5, the elements shown are the same as in FIG. 1 with the difference being that rather than a film destroying member in the form of a second heater downstream of scanner 16, the embodiment of FIG. 5 includes a film destroying member 30 which could be a shredder 300 as shown in FIG. 6, a high intensity illuminator 400 as shown in FIG. 7, or a chemical application 500 to effectuate destruction of the image as shown in FIG. 8. More specifically, in the embodiment of FIG. 6, after development by heater 14, and scanning at scanner 16, the film is transported by way of a roller 301 to film shredding device 300. Film shredding device 300 is adapted to destroy the film with the destroyed film being deposited in, for example, a waste collector 303.

In the embodiment of FIG. 7, the film destroying member is in the form of illuminator 400. Therefore, after scanning by scanner 16, the film is wound by winder 100 through illuminator 400. Illuminator 400 provides a high intensity illumination to the film to destroy images on the film. It should be appreciated that illuminator 400 could be combined with the apparatus of FIG. 3, where after illumination, the film is rewound through the heating element 14*a* to develop the illuminated film to a uniform maximum density. The advantage of such a combination would be that the amount of photo energy required for this combination of illumination and secondary heating would be less than the amount of photon energy required to destroy the image as per FIG. 7.

In the embodiment of FIG. 8, the film destroying member is in the form of chemical application 500. Therefore, after scanning at scanner 16, the film is transported by way of rollers 301 and winder 100 through chemical application 500 which applies a chemical treatment to the film to destroy or obscure the images on the film.

Therefore, after scanning, like the embodiment of FIG. 1, in the embodiments of FIGS. 5–8, the images can be sent to CPU 18 to provide for prints via printer 20, image products 22, or the images can be downloaded to network service provider 23 (internet). The exposed film or negative is thereafter sent to film destroying member 30 which, as indicated above, can be a shredder, a high intensity illuminator or a chemical application or treatment. The images can be destroyed by subjecting the film to a treatment with, for example, unreactive dyes or pigments, reactive dyes or pigments, reducing agents, oxidizing agents and the like at chemical application 500 that chemically destroys the images; or the film can be treated or bonded with water, solutions of gelatin, hydroxyethyl cellulose or other binders, adhesive, glues or the like to bind the film together such that it cannot be unwound from itself.

Therefore, the present invention provides for a thermal processing arrangement which addresses consumer concern about privacy when negatives are not returned following processing and scanning. The thermal processing arrangement as illustrated in the present invention provides for the rendering unscannable or the physical destruction of film after processing and scanning.

The invention has been described in detail with particular reference to certain preferred embodiments thereof, but it will be understood that variations and modifications can be effected within the spirit and scope of the invention.

What is claimed is:

1. An image processing apparatus comprising:

a first heater for heating an exposed photothermographic film to a first temperature suitable for thermal processing of the exposed film;

a scanner for scanning said processed photothermographic film to create a digital record file representative of images on said processed photothermographic film; and a second heater for heating said processed photothermographic film after said processed photothermographic film is scanned, said second heater heating said processed photothermographic film to a second temperature which develops said film to a maximum density level.

2. An image processing apparatus according to claim 1, wherein said second temperature is equal to or greater than said first temperature.

3. An image processing apparatus according to claim 1, wherein said second heater is downstream of said scanner with respect to a conveying direction of said photothermographic film in said apparatus, and second temperature is suitable to destroy the images on said processed photothermographic film.

4. An image processing apparatus according to claim 1, wherein said second temperature is greater than said first temperature.

5. An image processing apparatus comprising:

an adjustable heating assembly having at least a first temperature setting suitable for thermal processing of an exposed thermal film and a second temperature setting equal to or higher than said first temperature setting suitable for destroying images on said thermally processed film; and a scanner for scanning said thermally processed film to create a digital record file of images on said thermally processed film;

wherein after scanning, said thermally processed film is conveyed back to the heating assembly where the heating assembly is set at said second temperature setting for destroying the images on said thermally processed film.

6. An image processing apparatus according to claim 5, wherein said second temperature setting is greater than said first temperature setting.

7. An image processing apparatus comprising:

a heater for heating an exposed thermal film to a temperature suitable for thermal processing of said exposed film;

a scanner for scanning said thermally processed film to create a digital record file representative of images on said thermally processed film; and a destroying member for destroying said thermally processed film after said film has been scanned.

8. An image processing apparatus according to claim 7, wherein said destroying member is a film shredder which shreds said film.

9. An image processing apparatus according to claim 7, wherein said destroying member is a high intensity illuminator.

10. An image processing apparatus according to claim 7, wherein said destroying member is a chemical treatment which obscures images on the film.

11. An image processing apparatus comprising:

a heater for heating an exposed thermal film to a temperature suitable for thermal processing of said exposed film;

a scanner for scanning said thermally processed film to create a digital record file representative of images on said thermally processed film; and a destroying member for destroying said thermally processed film after said film has been scanned;

wherein said destroying member is a chemical treatment which binds the film onto itself so that it cannot be unwound.

12. An image processing method comprising the steps of:

heating an exposed thermal film to a first temperature suitable for thermal processing of said exposed film;

scanning said thermally processed film to create a digital record file representative of images on said thermally processed film; and after said scanning step, heating said thermally processed film to a second temperature equal to or greater than said first temperature which destroys the images on said thermally processed film.

13. An image processing method comprising the steps of:

heating an exposed thermal film to a temperature suitable for thermal processing of said exposed film;

scanning said thermally processed film to create a digital record file representative of images on said thermally processed film; and after said scanning step, destroying said thermally processed film.

14. A method according to claim 13, wherein said destroying step comprising shredding said thermally processed film.

15. A method according to claim 13, wherein said destroying step comprises illuminating said thermally processed film with a high intensity illuminator.

16. A method according to claim 13, wherein said destroying step comprises heating said film at said temperature for a period which is equal to or greater than a period for processing said film.

17. A method according to claim 13, wherein said destroying step comprises chemically treating said film to obscure images on the film.

18. An image processing method comprising the steps of:

heating an exposed thermal film to a temperature suitable for thermal processing of said exposed film;

scanning said thermally processed film to create a digital record file representative of images on said thermally processed film; and after said scanning step, destroying said thermally processed film;

wherein said destroying step comprises chemically treating said film to bind the film onto itself so that it cannot be unwound.

19. An image processing apparatus comprising:

a heater adapted to maintain a temperature suitable for thermal processing of an exposed thermal film; and a scanner for scanning said thermally processed film to create a digital record file of images on said thermally processed film, said scanner producing light exposure output at levels and spectral regions sufficient to fully expose a photographic element on the film;

wherein after scanning, said thermally processed film is conveyed back to the heater where, due to said light exposure by said scanner, the thermal process at said heater destroys the images on said thermally processed film.

* * * * *